US005613297A

United States Patent [19]

Dvorak et al.

[11] Patent Number: 5,613,297

[45] Date of Patent: Mar. 25, 1997

[54] WIRE INSERTION AND CUT-OFF TOOL AND METHOD OF USE

[75] Inventors: William A. Dvorak, Cary, N.C.; Alan H. Kirchner, Mount Holly, N.J.; Michael A. Lemacks, Apex, N.C.; Peter F. Lilienthal, II, Princeton, N.J.; Ivan Pawlenko, Holland; Michael F. Searle, Langhorne, both of Pa.; Frederick Simchock, Trenton, N.J.

[73] Assignee: Lucent Technologies Inc., Murray Hill, N.J.

[21] Appl. No.: 399,018

[22] Filed: Mar. 6, 1995

[51] Int. Cl.[6] ..... H01R 43/20

[52] U.S. Cl. ..... 29/861; 29/252; 29/566.4; 29/751; 29/752; 29/758; 7/107

[58] Field of Search ..... 29/252, 566.4, 29/747, 748, 750–752, 754, 758, 861, 845, 33 M; 7/107; 439/881

[56] References Cited

U.S. PATENT DOCUMENTS

| | | | |
|---|---|---|---|
| 3,604,092 | 9/1971 | Knickerbocker et al. | 29/750 |
| 3,896,534 | 7/1975 | Kaufman et al. | 29/752 X |
| 4,434,542 | 3/1984 | Forberg et al. | 7/107 X |
| 4,583,288 | 4/1986 | Young | 29/252 X |
| 4,696,090 | 9/1987 | Gregson et al. | 29/566.4 |
| 5,175,921 | 1/1993 | Krietzman et al. | 7/107 X |

FOREIGN PATENT DOCUMENTS

| | | | |
|---|---|---|---|
| 214619 | 3/1987 | European Pat. Off. | 29/750 |
| 477930 | 4/1992 | European Pat. Off. | 29/758 |
| 2739247 | 2/1979 | Germany | 29/566.4 |
| 2075903 | 11/1981 | United Kingdom | 29/566.4 |

*Primary Examiner*—Peter Vo
*Attorney, Agent, or Firm*—Robert B. Levy

[57] ABSTRACT

A tool (10) is provided for inserting a wire (12) into a wire-receiving slit (13) of an IDC (14) and for trimming the excess portion of the wire following insertion. The tool includes a prime mover (24) coupled to a guide member (36) having a wire-receiving notch (60) in one end, and a slot (64) coextensive with the notch. The guide member (36) has a blade (46) that is pivotally coupled to the guide member for movement across the wire-receiving notch (60). When the guide member (36) is positioned to partially envelop the IDC (14) in the slot (64), and the prime mover (24) is actuated, the guide member forces the wire (12) seated in the notch (62) into the slit (13) of the IDC. Simultaneously, the blade (46) pivots across the guide member (36) to sever any excess portion of the wire extending beyond the IDC (14).

11 Claims, 3 Drawing Sheets

WIRE INSERTION AND CUT-OFF TOOL AND METHOD OF USE

TECHNICAL FIELD

This invention relates to an apparatus for inserting a wire into an insulation displacement connector.

BACKGROUND ART

Many multi-conductor connector assemblies comprise a plurality of individual, electrically conductive, Insulation Displacement Connectors (IDCs), each providing an electrical connection to an individual wire of a multi-conductor cable. A typical IDC has a wire-receiving slit for displacing the insulation from the wire when the wire is forced into the slit to make an electrical connection with the IDC. The IDC advantageously obviates the need to manually remove a portion of the insulation on the wire prior to attaching the wire to the IDC.

When attaching a multi-conductor connecting assembly containing a plurality of individual IDCs to a multi-conductor cable, an operator first strips the multi-conductor cable to remove its outer jacket and expose the individual wires within the cable. Next, the operator separates the wires and then places each wire in registration with its corresponding IDC. Thereafter, the operator forces each wire into the wire-receiving slit of an associated IDC with the aid of a tool having a slotted end adapted to receive the IDC. In practice, a portion of each wire will extend beyond its corresponding IDC following attachment. To avoid a possible short circuit, the operator will trim the excess length of each wire. For a multi-conductor connector having many individual IDCs, the operator will have to trim many wires which can be time consuming.

Thus, there is a need for a device that obviates the need to separately trim the excess portion of each wire after attachment to its corresponding IDC.

BRIEF SUMMARY OF THE INVENTION

Briefly, in accordance with the invention, an apparatus is provided for attaching a wire to an IDC and for trimming any excess portion of the wire, (i.e., any amount exceeding a preselected portion), extending beyond the IDC during attachment. The apparatus comprises a guide member having a notch in one end for receiving and engaging a wire. Within the guide member is a slot coextensive with the notch. The slot is sized to at least partially receive the IDC. In this way, the wire in the notch of the guide member can be inserted into the IDC when the guide member is positioned to partially envelop the IDC. A wire-cutting blade is pivotally connected to the guide member for movement across the notch. A prime mover is coupled to the guide member for displacing the guide member to force the guide member against the IDC to insert the wire therein and for pivoting the wire-cutting blade across the notch as the guide member forces the wire into the IDC. In this way, the blade severs the excess portion of the wire extending beyond the IDC during wire insertion.

DETAILED DESCRIPTION

Figure 1:
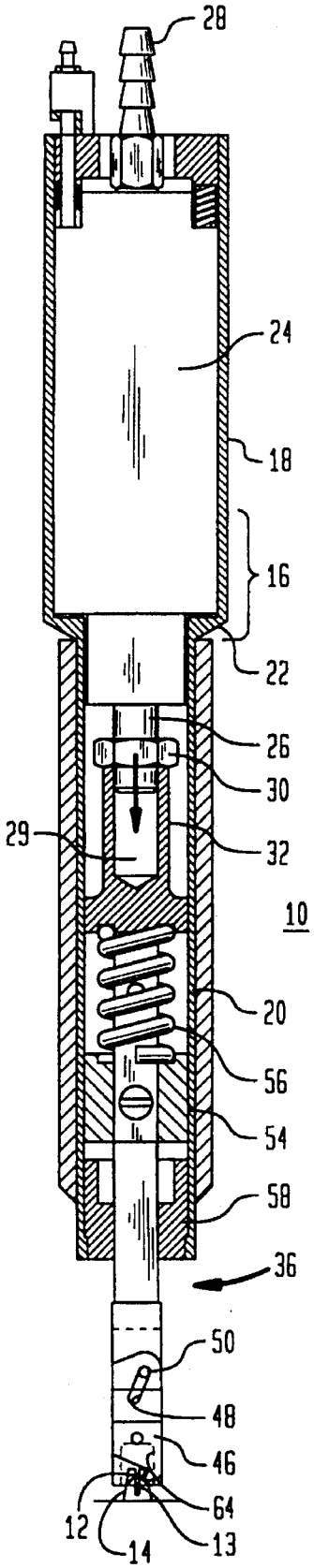
FIG. 1 is a front view, in cross section, of a tool, in accordance with the invention, for inserting a wire into an IDC and for trimming the excess portion of the wire during insertion.

FIG. 1 depicts a front view, in cross section, of a tool 10, in accordance with the invention, for inserting a wire 12 into a wire-receiving slit 13 of an IDC 14 and for trimming the excess portion of the wire extending beyond the IDC during insertion. The tool 10 comprises a housing 16 configured of upper and lower cylindrical portions 18 and 20 separated by a necked-down region 22.

The upper housing portion 18 houses an air cylinder 24 having a piston (not shown) connected to a rod 26 whose lower end extends into the lower housing portion 20. When pressurized air is forced into the air cylinder 24 though an inlet port 28, the air cylinder drives the rod 26 downward, as indicated by arrow 29. A nut 30 is threaded onto the lower end of the rod 26 to bear against the upper end of a sleeve 32 that fits tightly about the lower end of the rod. By threading the nut 30 along the rod 26, the downward stroke of the sleeve can be varied. The sleeve 32 has a flanged lower end 34 that bears against the top of a guide member 36 whose details are best seen in FIGS. 2 and 3.

Figure 2:
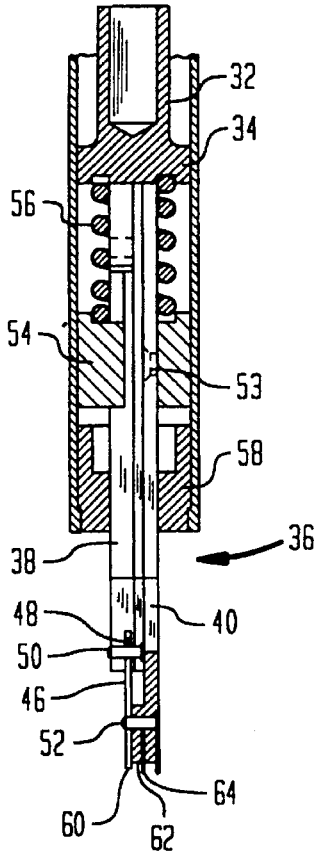
FIG. 2 is a side view, in cross section, of a portion of the tool of FIG. 1.
Figure 3:
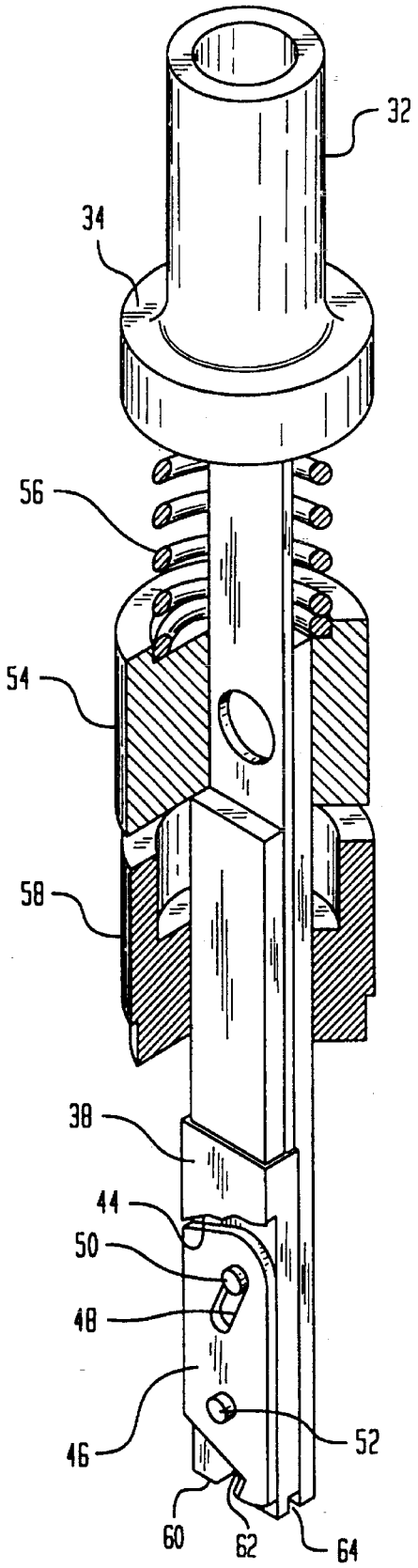
FIG. 3 is a perspective view of a portion of the tool of FIGS. 1 and 2.

Referring to FIGS. 2 and 3, the guide member 36 comprises a pair of elongated, prismatic bars 38 and 40. As seen in FIG. 3, the bar 38 sits partially in a cutout 42 in the bar 40 and extends upward beyond the bar 40 to abut the flanged end 34 of the sleeve 32. The lower end of the bar 38 has a slot 44 for receiving the upper end of a blade 46 that depends below the bar. The blade 46 has a cutting edge 47 at a slight angle with the right-hand blade edge as seen in FIG. 3. As best seen in FIGS. 1 and 3, the blade 46 has a race track-shaped opening 48 above the cutting edge 47. The opening 48 in the blade 46 extends diagonally upward across the blade from left to right. A clevis pin 50 extends through the bar 38 and into the opening 48 in the blade 46 to ride on the walls of the opening. A second clevis pin 52 extends through the blade 46 and into the bar 40 to permit the blade to pivot about the pin. When the bar 38 is displaced downward, relative to the bar 40, the clevis pin 50 rides along the walls of the opening 48 in the blade 46, causing the blade to pivot about the pin 52 so the blade sweeps across the bar 40 in a clockwise motion.

As best seen in FIG. 2, a fastener 53 secures the bar 40 of the guide member 36 to an annular retainer 54 disposed in the cylindrical casing 20. A compression spring 56 sits between the ranged lower end 34 of the sleeve 32 and the upper end of the retainer 54. The spring 56 urges the retainer 54 downward towards a cap 58 pressed into the lower housing portion 20 below the retainer. As will be appreciated, the cap 58 acts as a stop for the retainer 54 when the rod 26 forces the retainer downward.

Referring to FIG. 3, the bar 40 has a V-shaped notch 60 in its lower end that extends through the bar from its front face to its back face. At the vertex of the notch 60 is a half-rounded channel 62 extending through the bar and sized to receive the wire 12. The channel 62 lies just below and to the left of the diagonal cutting edge 47 of the blade 46 while the blade is positioned so that the clevis pin 50 sits at the upper end of the opening 48. In other words, while the blade 46 remains substantially parallel to the bars 38 and 40, the wire 12, situated in the channel 62 at the top of the notch 60, remains away from, and out of contact with, the cutting edge 47 on the blade.

As best seen in FIGS. 2 and 3, the bottom of the bar 40 has an slot 64 that extends upward into the bar coextensive with the notch 60. The slot 64 is sized to at least partially receive (envelop) the IDC 14 of FIG. 1. In this way, the wire 12 received in the channel 62 in the bar 40 can be forced into the wire-receiving slit 13 of the IDC 14 (see FIG. 1 and 4–6) when the bar 40 is positioned to at least partially envelop the IDC 14 within the aperture 64.

Figure 4:
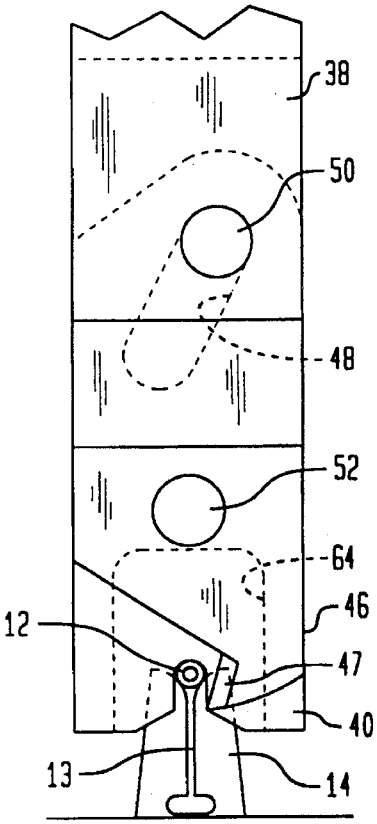
FIGS. 4, 5 and 6 depict front views of a portion of the tool of FIGS. 1–3 showing the sequence of steps associated with inserting the wire into the IDC and with trimming the excess portion of the wire during insertion.
Figure 5:
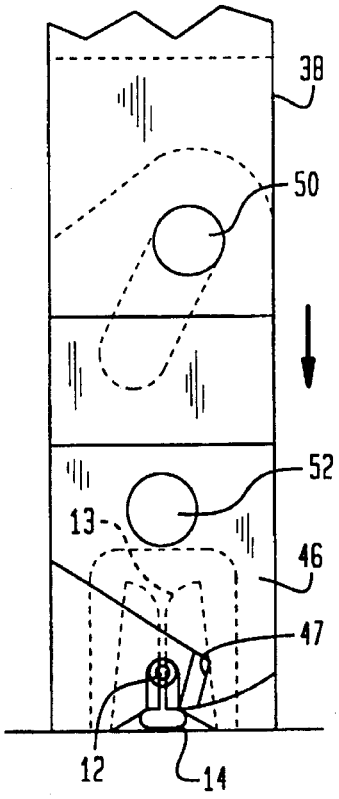
Figure 6:
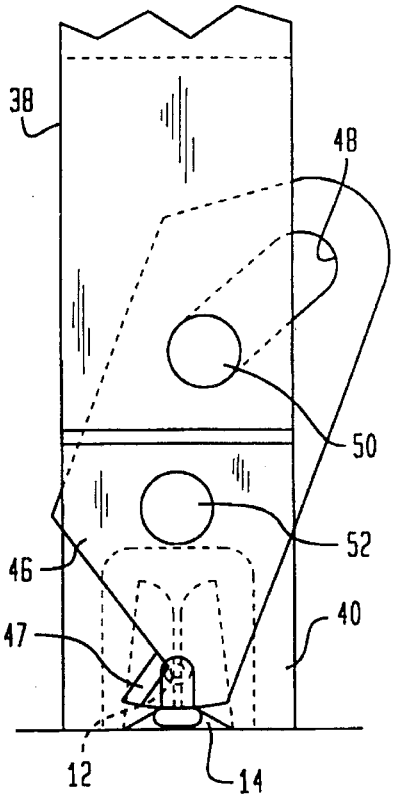

The overall operation of the tool 10 may best be understood by reference to FIG. 1 and FIGS. 4–6. The wire 12 is inserted into the IDC 14 by placing the wire at the top of the wire-receiving slit 13 in the IDC as best seen in FIG. 4. Next, the tool 10 is positioned to partially envelop the IDC 14 within the slot 64 in the bottom of the bar 40. Thereafter, pressurized air is admitted through the port 28 of FIG. 1 to actuate the air cylinder 24 and drive the rod 26 downward, thereby urging the ranged end 34 of the sleeve 32 against the spring 56. In turn, the spring 56 forces the retainer 54 of FIG. 1 and the bar 40 downward. Referring to FIG. 5, as the bar 40 moves downward, the bar forces the wire 12 seated in the channel 62 deeply into the wire-receiving slit 13 of the IDC 14. As the wire 12 enters the wire-receiving slit 13, the slit displaces the insulation from the wire 12. In this way, the wire 12 makes an electrical connection with the IDC.

As the bar 40 is driven downward by the rod 26, the bar 38 is also driven downward. So long as the bars 38 and 40 move in unison, the blade 46 does not pivot and remains coextensive with the bars 38 and 40 as seen in FIG. 5. The overall dimensions of the retainer 54 and the spring 56 (both of FIG. 1) are such that the retainer contacts the cap 58 of FIG. 1 before the rod 26 completes its full downward stroke. Thus, after the retainer 54 contacts the cap 58, the bar 38 continues to move downward. As the bar 38 moves downward while the bar 40 remains fully extended, the clevis pin 50 of FIG. 6 rides along the walls of the Slot 48 in the blade 46, thereby pivoting the blade. As the blade 46 pivots, the cutting edge 47 of the blade severs the excess portion of the wire 12 extending beyond the IDC 14. The excess portion is defined as any amount of the wire 12 exceeding a preselected portion (corresponding to the length of the wire running across the channel 62 between the slot 64 of FIG. 3 and the blade 46).

Once the wire 12 has been seated in the wire-receiving slit 13 of the IDC 14, and the excess portion of the wire has been trimmed, the flow of pressurized air into air cylinder 24 of FIG. 1 is cut-off. With no pressurized air flowing into the cylinder 24 to displace the rod 26 downward, the spring 56 of FIG. 1 forces the rod 26 upward. Since the rod 26 is connected to the bar 38, the upward movement of the bar 40 causes the bar 38 to move upward as well. As the bar 38 moves upward, the blade 46 pivots back to its original position at which the cutting edge 47 is away from the channel 62 (see FIG. 3) in the bar 40, permitting a new wire 12 to be received in the channel 62.

The foregoing describes a tool 10 that advantageously inserts a wire 10 into a wire-receiving slit 13 of an IDC 14 while simultaneously trimming the excess portion of the wire extending beyond the IDC during insertion.

It is to be understood that the above-described embodiments are merely illustrative of the principles of the invention. Various modifications and changes may be made thereto by those skilled in the art which will embody the principles of the invention and fall within the spirit and scope thereof.

What is claimed is:

1. A method for inserting a wire into a wire-receiving slit of an Insulation Displacement Connector (IDC), comprising the steps of:

placing the wire at the wire-receiving slit of the IDC;

placing a guide member, having a wire-receiving notch extending therethrough at one of its ends and a slot extending into the guide member coextensive with the notch, on the IDC so that the IDC partially seats in the slot while the wire seats in the wire-receiving notch;

urging the guide member against the IDC using a force supplied by a power stroke of a prime mover that occurs as a portion of the prime mover moves axially toward the IDC so that the wire seated in the wire-receiving notch is urged deeply into the wire-receiving slit of the IDC; and pivoting a wire-cutting blade across the guide member adjacent to the notch during the power stroke of the prime mover to sever an excess portion of the wire extending beyond the IDC.

2. Apparatus for inserting a wire into a wire-receiving slit of an Insulation Displacement Connector (IDC), comprising:

a guide member having a wire-receiving notch extending therethrough at one of its ends and a slot extending into the guide member coextensive with the notch, the guide member comprising:

a first elongated bar, and a second elongated bar that is axially movable with respect to the first elongated bar, wherein a first end of the second elongated bar is connected to the prime mover;

a wire-cutting blade pivotally mounted to the guide member adjacent the wire-receiving notch for movement thereacross; and a prime mover coupled to the guide member for urging the guide member against the IDC during a power stroke of the prime mover that occurs as a portion of the prime mover connected to the second elongated bar moves axially toward the IDC, to urge the wire in the wire-receiving notch of the guide member deeply into the wire-receiving slit of the IDC and for moving the second elongated bar axially relative to the first elongated bar during the power stroke, the relative movement pivoting the blade across the wire-receiving notch to trim an excess portion of the wire extending beyond the IDC.

3. The apparatus according to claim 2, wherein the prime mover comprises:

a cylinder having a rod that extends out from the cylinder when pressurized gas in admitted into the cylinder; and means for admitting pressurized gas into the cylinder.

4. The apparatus according to claim 3, wherein the wire-receiving notch and the coextensive slot are provided on the first elongated bar and wherein the guide member further comprises:

pivot means for pivotally coupling the blade to the first bar to permit the blade to pivot about the first pivot means and move across the wire-receiving notch; and coupling means for movably coupling the blade to the second bar to permit the blade to move with respect to the second bar, the coupling means causing the blade to pivot about the pivot means and to move across the wire-receiving notch in the first bar when the second bar moves axially relative to the first bar.

5. The apparatus according to claim 4, further comprising:

an annular retainer circumscribing both the first and second bars;

a fastener securing the retainer to the first bar; and a spring disposed between the retainer and the rod of the prime mover, the spring urging the retainer and the first bar away from the rod of the prime mover.

6. The apparatus according to claim 5, further comprising:

a cylindrical housing circumscribing the first and second bars, the retainer and the spring; and a collar situated within the housing such that the retainer is spaced from the collar when the spring is in a relaxed state, and wherein the retainer contacts the collar to stop movement of the first bar relative to the housing when the primer mover is actuated to displace the retainer.

7. The apparatus according to claim 2, wherein the wire-receiving notch and the coextensive slot are provided on the first elongated bar.

8. The apparatus according to claim 7, wherein the guide member further comprises:

pivot means for pivotally coupling the blade to the first bar to permit the blade to pivot about the first pivot means and move across the wire-receiving notch; and coupling means for movably coupling the blade to the second bar to permit the blade to move with respect to the second bar, the coupling means causing the blade to pivot about the pivot means and to move across the wire-receiving notch in the first bar when the second bar moves axially relative to the first bar.

9. The apparatus according to claim 8, further comprising:

spring means for urging the first bar away from the prime mover.

10. The apparatus according to claim 9 wherein the spring means comprises:

an annular retainer circumscribing both the first and second bars;

a fastener securing the retainer to the first bar; and a spring disposed between the retainer and the prime mover for urging the retainer and the first bar away from the prime mover.

11. The apparatus according to claim 10, further comprising:

a cylindrical housing circumscribing the first and second bars, the retainer and the spring; and a collar situated within the housing such that the retainer is spaced from the collar when the spring is in a relaxed state, and wherein the retainer contacts the collar to stop movement of the first bar relative to the housing when the primer mover is actuated to displace the retainer.

* * * * *